US008026884B2

(12) United States Patent
Hsieh et al.

(10) Patent No.: US 8,026,884 B2
(45) Date of Patent: Sep. 27, 2011

(54) OPTICAL MODULE AND POSITIONING FRAME THEREOF

(75) Inventors: Yao-Jen Hsieh, Ping Tung Hsien (TW); Huan-Hsin Li, Miao Li Hsien (TW); Chih-Sung Wang, Hsinchu Hsien (TW)

(73) Assignee: AU Optronics Corp., Hsinchu (TW)

( * ) Notice: Subject to any disclaimer, the term of this patent is extended or adjusted under 35 U.S.C. 154(b) by 1472 days.

(21) Appl. No.: 11/486,019

(22) Filed: Jul. 14, 2006

(65) Prior Publication Data

US 2007/0013627 A1 Jan. 18, 2007

(30) Foreign Application Priority Data

Jul. 15, 2005 (TW) ..... 94124044 A

(51) Int. Cl.
*G09G 3/36* (2006.01)

(52) U.S. Cl. ..... 345/89; 345/204

(58) Field of Classification Search ..... 345/89, 345/204

See application file for complete search history.

(56) References Cited

U.S. PATENT DOCUMENTS 6,717,564 B2 * 4/2004 Albu et al. ..... 345/98
7,102,604 B2 * 9/2006 Hong ..... 345/87
7,113,158 B1 * 9/2006 Fujiwara et al. ..... 345/87
2002/0036604 A1 * 3/2002 Yamazaki et al. ..... 345/76
2003/0011554 A1 * 1/2003 Albu et al. ..... 345/89
2003/0214473 A1 * 11/2003 Lee ..... 345/87
2004/0169627 A1 * 9/2004 Hong ..... 345/89
2005/0261883 A1 * 11/2005 Shen et al. ..... 703/13
2006/0158410 A1 * 7/2006 Fujine ..... 345/89
2007/0008252 A1 * 1/2007 Seki ..... 345/76

* cited by examiner

*Primary Examiner* — Bipin Shalwala
*Assistant Examiner* — Afroza Chowdhury
(74) *Attorney, Agent, or Firm* — Birch, Stewart, Kolasch & Birch, LLP

(57) ABSTRACT

A system for driving a liquid crystal display is provided. The system receives a video signal including a first predetermined gray level signal and a second predetermined gray level signal. The system includes a memory, an impulse signal module, a first multiplexer and a detection unit. The memory stores the first predetermined gray level signal. The impulse signal module receives the first and second predetermined gray level signal to generate a plurality of impulse signals. The first multiplexer receives the plurality of impulse signals and outputs the second predetermined gray level signal or the plurality of impulse signals according to the first control signal. The detection unit generates a first control signal to be applied to the first multiplexer according to the first predetermined gray level signal and the second predetermined gray level signal.

18 Claims, 6 Drawing Sheets

OPTICAL MODULE AND POSITIONING FRAME THEREOF

BACKGROUND OF THE INVENTION (1) Field of the Invention

The present invention pertains to a system and a method for driving a liquid crystal display, in particular to an impulse-type application of such system and method.

(2) Description of the Prior Art

Liquid crystal display's main advantages are easy to achieve high resolution and its slim size. Therefore, liquid crystal display is widely used in notebook computers. Because of constant developments in large size display, liquid crystal displays also become the main stream monitors in desktop computers.

Please refer to FIG. 1. FIG. 1 is a basic diagram of the liquid crystal display 10. Within the liquid crystal display 10, a liquid crystal panel 12 has a plurality of pixels 121. By applying different driving voltage to liquid crystal molecules of pixel 121, the tilt angle of liquid crystal molecules can be changed. The liquid crystal molecules have "light valve" function. By controlling the tilt angle of liquid crystal molecules, the light transmitted from a backlight 14, which is disposed underneath the liquid crystal panel 12, can be controlled. Each pixel 121 of the liquid crystal panel 12 has a specific predetermined penetration rate to light at a predetermined time interval, which is associated with specific gray levels for forming visual frames.

Typically, in computers (as mentioned as notebook computers and desktop computers in above), screen displays mainly display in static-state condition. The so called "static state" means that a pixel 121 display the same gray level when a previous frame refreshes to a current frame. For example, when computer is running word processing program, most of the pixel 121 within the screen frame mainly displaying in "static state", the pixel 121 of the area of currently word typing is called "dynamic state". The so called "dynamic state" means that a pixel 121 displays different gray level when a previous frame refreshes to a current frame. For instance, the television screen mainly displays in "dynamic state", or when using computer to play movie clips or animation clips, the screen also mainly displays in "dynamic state".

The displaying characteristic of liquid crystal display is more suited for static-state displaying. The video control of liquid crystal display 10 depends on applying specific electrical voltage to liquid crystal molecules. Typical liquid crystal driving voltage is shown in FIG. 2A. It maintains a specific voltage during a frame time. This kind of method for driving liquid crystal display is known as a "hold-type". The liquid crystal display 10 maintaining the "hold-type" driving mode typically uses a storage capacitor to store the voltage value of driving voltage until the driving voltage of the next frame being input to the storage capacitor.

As illustrated in FIG. 2, under the condition of maintaining a constant voltage value during a frame time, human's visional brightness perception is directly proportional to the accumulating time. Therefore, the liquid crystal display 10 using the "hold-type" will suffer dragging screen image when displaying dynamic-state frames due to the persistence of human vision. Human vision can easily perceive the remaining gray level of the previous frame when observing the current frame.

Please refer to FIG. 2B, which illustrates driving voltage of "impulse-type". Another application of image displaying driving method is called an "impulse-type". The "impulse-type" is typically used in traditional television or Cathode Ray Tube (CRT) monitor, because the electron beam of television or CRT monitor scanning speed is usually high, relatively. Typically, only one impulse is applied during one frame time. The display brightness is controlled mainly by coordinating the strength of electron beam. The brightness perceiving by human vision is the accumulation of brightness during the frame time. If the brightness accumulation value is the same during the frame time as that of a hold-type pixel, human vision identifies it as the same gray level. This means if FIG. 2A and FIG. 2B has the same brightness accumulation value during the same frame time, human vision will perceive exactly the same gray level.

As shown in FIG. 2B, the brightness of the "impulse-type" occurs at the early stage of each frame time because of the high speed scanning of electron beam. Therefore, from frame to frame, previous mentioned dragging screen image phenomena rarely happens, even under the "dynamic state". This is because each frame can be isolated under the "impulse-type", the residual brightness of the previous frame has less influence to human vision while perceiving the current frame.

Impulse-type driving is used in traditional television or CRT monitor. Currently, liquid crystal display also uses "impulse-type" driving. But it is mainly used in liquid crystal television products, very less in liquid crystal monitors for desktop or notebook computers. Although liquid crystal display with "impulse-type" can improve its drawback on dynamic-state displaying, however, it suffers flashing side-effect when displaying static-state frames. Therefore, using it in application of computer monitor products remained difficult. The flashing side-effect also is a typical problem in traditional television or CRT monitor.

According to the previous mentioned drawbacks and limits of prior liquid crystal displays, the objectives and summary of present invention are described below.

SUMMARY OF THE INVENTION

An objective of the present invention is to improve the problem of dragging screen image phenomenon which easily occurs in prior art liquid crystal display technology.

Another objective of the present invention is to provide an impulse-type application of liquid crystal display driving method for improving dragging screen image phenomenon.

Another objective of the present invention is to avoid flashing screen problem in "static state" causing by impulse-type driving.

Another objective of the present invention is to provide an liquid crystal driving system capable of showing outstanding performance in both dynamic-state and static-state screen display.

A method for driving a liquid crystal display is provided. The liquid crystal display includes a plurality of pixels. Each pixel is capable of displaying a plurality of gray levels. A first predetermined gray level signal determines a corresponding gray level for one of the plurality of pixels in a previous frame. A current frame follows immediately after the previous frame. And a second predetermined gray level signal determines a corresponding gray level for the one of the plurality of pixels in the current frame. The present method comprising:

a) comparing the gray level associated with the second predetermined gray level signal to the gray level associated with the first predetermined gray level signal.

b-1) applying a hold-type voltage to drive the pixel in the current frame if the gray level associated with the second predetermined gray level signal and the gray level associated with the first predetermined gray level signal are substantially the same; and b-2) applying an impulse-type voltage to drive the one of the plurality of pixels in the current frame if the gray level associated with the second predetermined gray level signal and the gray level associated with the first predetermined gray level signal are different.

A system for driving a liquid crystal display is provided. The system receives a video signal including a first predetermined gray level signal and a second predetermined gray level signal. The system includes a memory, an impulse signal module, a first multiplexer and a detection unit. The memory stores the first predetermined gray level signal. The impulse signal module receives the first and second predetermined gray level signal to generate a plurality of impulse signals. The first multiplexer receives the plurality of impulse signals and outputting the second predetermined gray level signal or the plurality of impulse signals according to the first control signal. The detection unit generates a first control signal to be applied to the first multiplexer according to the first predetermined gray level signal and the second predetermined gray level signal.

These and other objectives of the present invention will no doubt become obvious to those of ordinary skill in the art after reading the following detailed description of the preferred embodiment which is illustrated in the various figures and drawings.

BRIEF DESCRIPTION OF THE DRAWINGS

From following detail description with illustrated diagrams, the advantages of the present invention can be easily comprehended.

DESCRIPTION OF THE PREFERRED EMBODIMENT

The present invention aims to provide a complete solution for prior liquid crystal display's incapability of handling "dynamic state" and "static state" between frame to frame displaying.

Figure 3A:
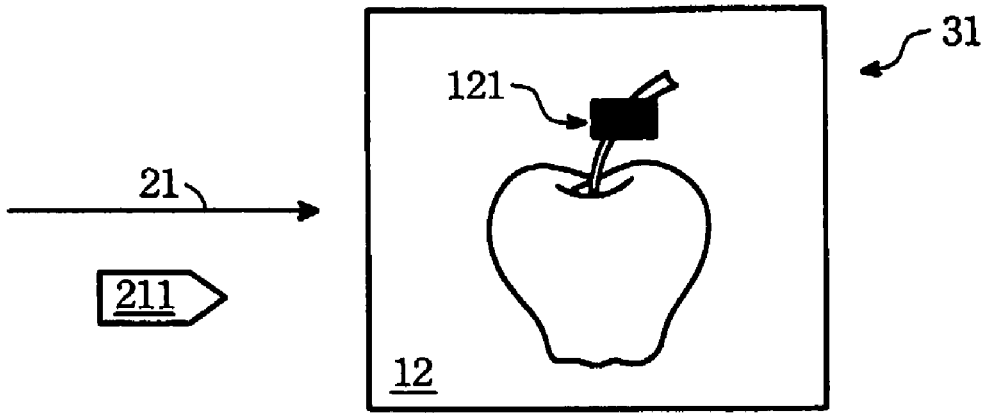
FIG. 3A and FIG. 3B each illustrates "previous frame" and "current frame" of liquid crystal display.
Figure 3B:
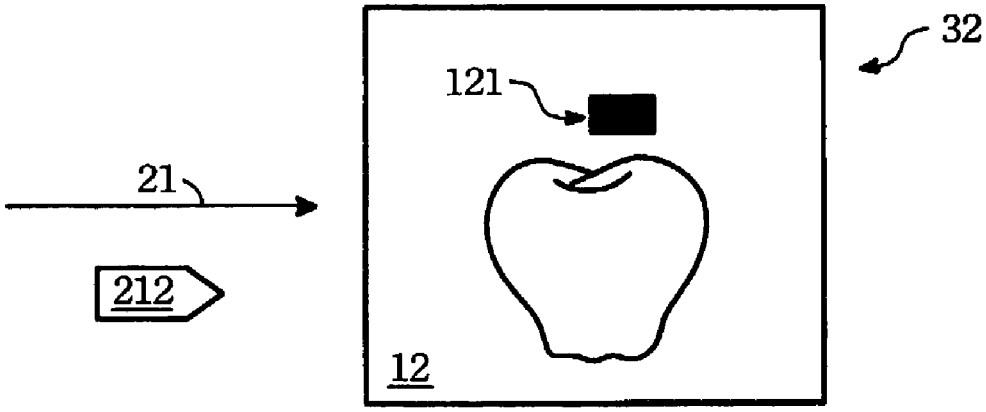

Please refer to FIG. 3A and FIG. 3B. The liquid crystal panel 12 can display a plurality of frames. For example, after the liquid crystal panel 12 displays a previous frame 31, a current frame 32, which follows immediately after the previous frame 31, is then shown. Please focus on this point, due to the present invention's application is related to any two connecting frames, "the previous frame" and "the current frame" represent any of two connecting frames, and does not only implicating two specific frames.

The content displayed by the liquid crystal panel 12 is transmitted by a video signal 21. The video signal 21 could be coming from video disk player (DVD or VCD), computer VGA card or other video source. The video signal 21 includes content of the mentioned plurality of frames including a plurality of predetermined signals being associated with gray levels for pixels.

As shown in FIG. 3A and FIG. 3B, a first predetermined gray level signal 211 is used for determining the gray level of the pixel 121 in the previous frame 31. A second predetermined gray level signal 212 is used for determining the gray level of the pixel 121 in the current frame 32.

The method for driving the liquid crystal panel 12 of present invention mainly comprises the following steps:

a) comparing the gray level associated with the second predetermined gray level signal 212 to the gray level associated with the first predetermined gray level signal 211;

b-1) applying a hold-type voltage to drive the pixel 121 in the current frame 32 if the gray level associated with the second predetermined gray level signal 212 and the gray level associated with the first predetermined gray level signal 211 are substantially the same;

b-2) applying an impulse-type voltage to drive the pixel 121 in the current frame 32 if the gray level associated with the second predetermined gray level signal 212 and the gray level associated with the first predetermined gray level signal 211 are different.

In the present invention, the "impulse-type voltage" includes a plurality of driving voltages to keep liquid crystal molecules spinning during the early stage of the frame time of the current frame 32. In such a manner, the brightness of the pixel 121 is mainly distributed at the early stage of the frame time. As to the "hold-type voltage" of the present invention, it is used for keep liquid crystal molecules maintaining a predetermined tilt angle within the frame time of the current frame 32. In such a manner, the brightness of the pixel 121 is evenly distributed within the frame time of the current frame 32.

Figure 4A:
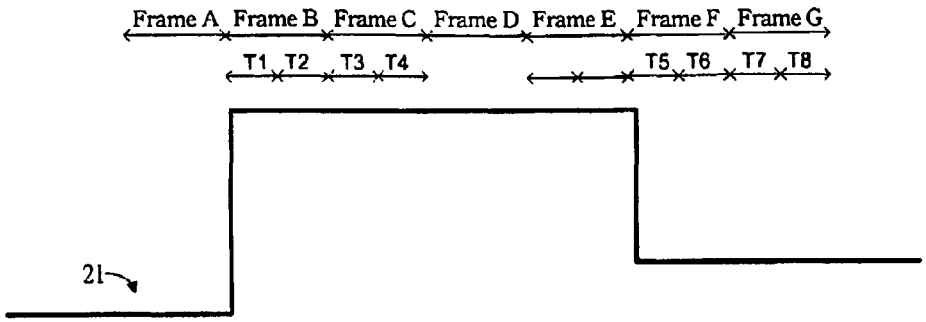
FIG. 4A, FIG. 4B and FIG. 4C each illustrates video signal, driving signal and brightness changing condition of pixel in an embodiment of the present invention.
Figure 4B:
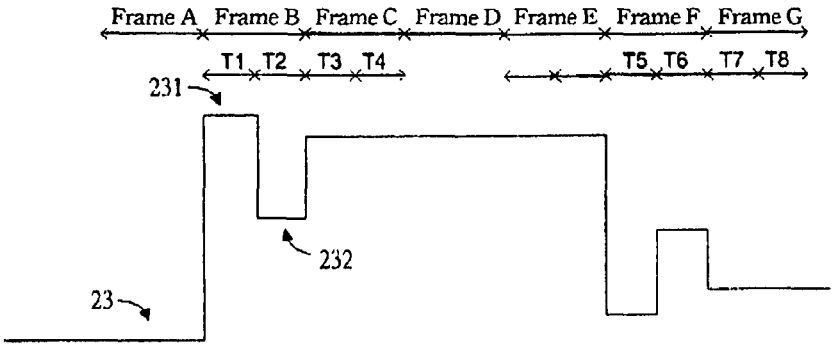

Please refer to FIG. 4A and FIG. 4B to further understand the present invention. FIG. 4A demonstrates the video signal 21, the high and the low amplitudes of signal value represent different gray levels (For example, the previously mentioned first predetermined gray level signal 211 and the second predetermined gray level signal 212). FIG. 4B shows a driving signal 23. The different height or low signal values of the driving signal 23 also represent different gray levels. The driving signal 23 is used for driving the pixel 121 of the liquid crystal panel 12. The method provided by the present invention is relied on the video signal 21 to generate the driving signal 23. Therefore, the video signal 21 has to be detected firstly.

Through the present invention, the liquid crystal panel 12 is capable of having improved performance under both "dynamic state" and "static state". The fundamental spirit of present invention is driving with "hold-type" under "static state", and driving with "impulse-type" under "dynamic state".

The condition of "static state" is shown as the video signal 21 in FIG. 4A from frame D to frame E. When the current frame (FIG. 3B 32) is the frame E, due to the gray level signal of the frame E (the second predetermined gray level signal 211) is substantially the same as the previous frame (FIG. 3B 212, FIG. 4A frame D). Therefore, "hold type" driving is being applied to frame E.

Figure 2A:
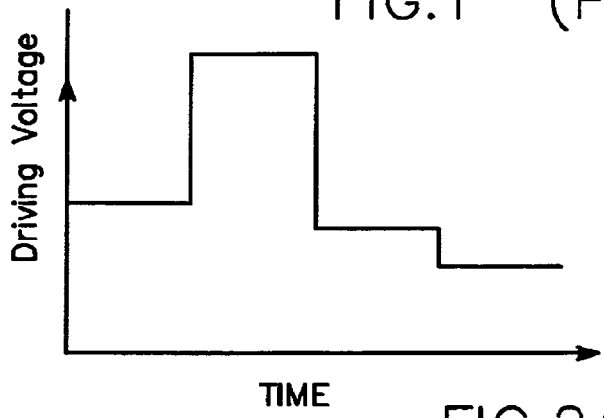
FIG.2A (Prior Art)
FIG. 2A illustrates a typical liquid crystal driving voltage of "hold-type".
Figure 2B:
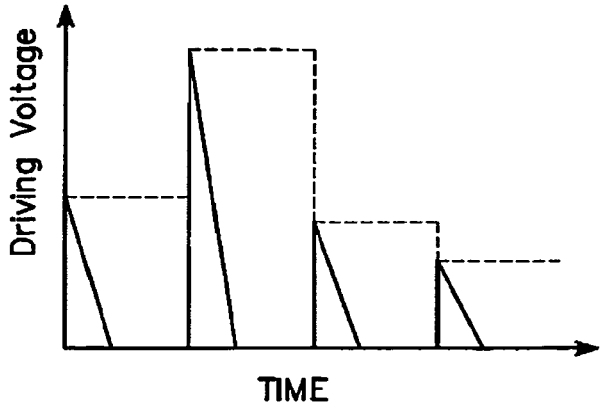
FIG.2B(Prior Art)
FIG. 2B illustrates a driving voltage of "impulse-type".

As illustrated in FIG. 4B, within the frame time of frame E, driving signal 23 provides a single value signal and maintaining the signal for a frame time. This is so called the "hold-type" driving which also is shown in FIG. 2A. An important point worth mentioning, although the final form of signal being received by liquid crystal molecules is in a form of electric voltage, however, driving signal 23 mentioned in the present invention is not of the limit of electric voltage. The driving signal 23 can also be of electric current within the process.

The condition of "dynamic state" is shown in FIG. 4A from frame A to frame B. From the video signal 21 as illustrated, when the current frame (FIG. 3B 32) is frame B, due to the gray level signal of frame B (the first predetermined gray level signal 211) is different from frame A. Therefore, frame B is of a dynamic-state frame and the present invention drives the dynamic-state frame by "impulse-type". The "impulse-type" driving applies a plurality of impulse signals (refer to FIG. 4B 231 and 232) to the pixel 121 for achieving the impulse-type driving.

As illustrated in FIG. 4B, within the frame time of frame B, the signal provided by driving signal 23 can be differentiated in two stages (Time Division T1 and T2), which comprising two different signal values: the first impulse signal 231 and the second impulse signal 232. According to the driving method mentioned above, please refer to FIG. 4C, which is a chart of brightness changing curve corresponding to FIG. 4B. The pixel 121's brightness depends on liquid crystal molecule's tilt angle. However, the reacting time of liquid crystal molecules has its physical limit, which unlike electrical signal can be changed instantly. Therefore, within time division T1 and time division T2, liquid crystal molecules are unable to react instantly and change its tilt angle matching with the defined tilt angle of the driving signal 23. As a result, the brightness curve is appeared more like a curve line, gradually changing the tilt angle to the defined tilt angle of first impulse signal 231 and second impulse signal 232. Therefore, when driven by "impulse-type", the brightness variation of the pixel 121 in microcosmic view appears as FIG. 4C, frame B or frame F.

The present invention uses "impulse-type" driving under "dynamic state" by applying a plurality of impulse signal (e.g. 231 and 232). It makes the brightness accumulation appearing at the early stage of a frame time. The actual displaying effect is very close to the prior art technology's traditional television or cathode ray tube (CRT) monitor's "impulse-type" driving method. It can effectively improve the drawback of dragging screen image phenomenon of prior art liquid crystal display monitor when displaying dynamic-state frames.

Figure 4C:
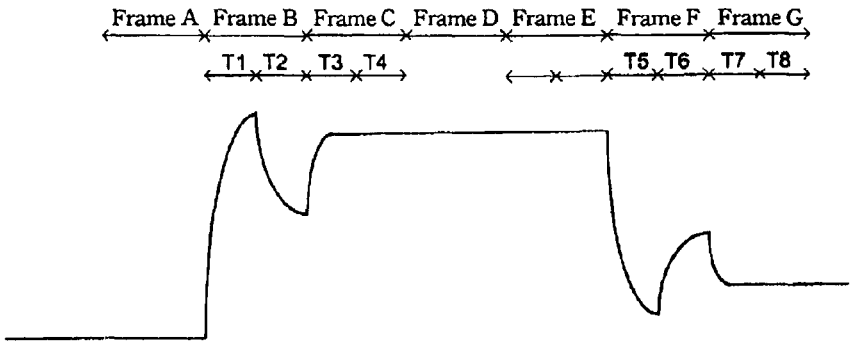

Please refer to FIG. 4A, FIG. 4B and FIG. 4C, and compare all of frame B to frame C. As shown in FIG. 4A, under the request of the video signal 21, frame B and frame C show the same gray level. In FIG. 4B, after the driving signal 23 finished its "impulse-type" driving for frame B, it switches to "hold-type" driving to drive frame C. As shown in FIG. 4C, because of the physical property of liquid crystal molecules, it will take a period of reacting time to reach the required brightness at the early stage of frame C.

Please still refer to frame B and frame C, although frame B uses "impulse-type" driving and frame C uses "hold-type" driving, however, both of them display the same gray level (as shown in FIG. 4A, where under the request of video signal 21). Therefore, in FIG. 4C, the brightness accumulation of time division T1 and T2 is equal to the brightness accumulation of time division T3 and T4. In other words, to human visual perception, viewing frame B and viewing frame C will be like viewing the same gray level. In the present invention, when the previously mentioned second predetermined gray level signal (212 of FIG. 3B, which related to the current frame 32) is of a specific value, no matter the corresponding pixel 121 is driven by "impulse-type" driving or "hold-type", the brightness accumulation of the frame time is substantially the same.

The achieved advantages of the present invention are able to avoid the drawback of dragging screen image phenomenon for "dynamic state", and also able to prevent the flashing screen problem for "static state", like in frame D and in frame E.

When executing "impulse-type" driving, it relies on gray level changes from the previous frame 31 to the current frame 32 to generate impulse-type voltage, which includes a plurality of applicable impulse signals. For instance, the first predetermined gray level signal 231 and the second predetermined gray level signal 232 showed in FIG. 4B. The decision making on the value of impulse signal value is based on using various signal value to perform actual test on the pixel 121, and checking the brightness accumulation of pixel 121 to get the most applicable signal value. Moreover, an impulse signal data table can be built in real application. Using gray level changes in between two neighboring frames to perform check table and get most applicable signal value.

Figure 5:
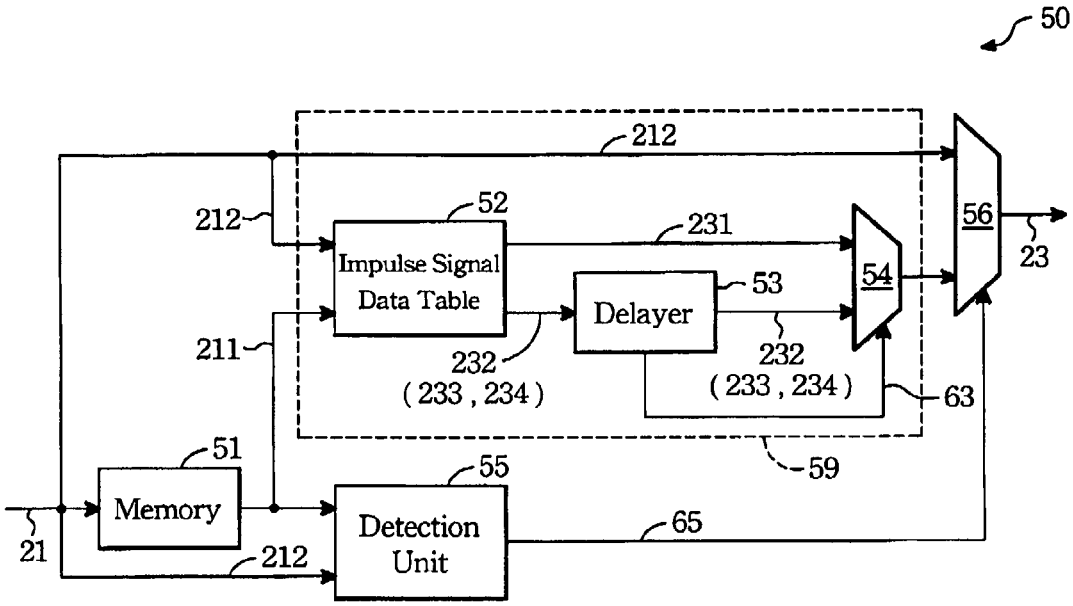
FIG. 5 is an over view diagram of the liquid crystal driving system.

The system for driving liquid crystal display of the present invention is illustrated in FIG. 5. Please also refer to FIG. 3A and FIG. 3B for reference.

The system 50 receives the video signal 21. As shown in FIG. 3A and FIG. 3B and the related description mentioned above, the video signal 21 includes the first predetermined gray level signal 211 and following second predetermined gray level signal 212, which respectively determines gray level of the previous frame 31 and the following current frame 32 for the pixel 121.

Figure 1:
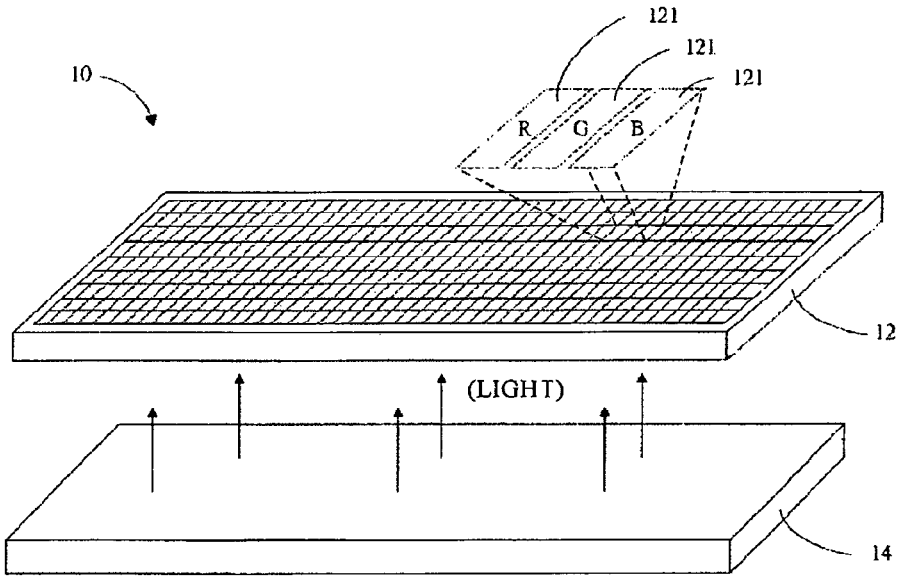
FIG.1 (Prior Art)
FIG. 1 is a basic diagram of a liquid crystal display.

The system 50 is for driving a liquid crystal display such as the liquid crystal display 10 shown in FIG. 1, especially for driving the liquid crystal panel 12 of the liquid crystal display 10. The system 50 includes a memory 51, an impulse signal module 59, a detection unit 55 and a first multiplexer 56. The impulse signal module 59 includes an impulse signal data table 52, a delayer 53 and a second multiplexer 54.

The memory 51 can store the first predetermined gray level signal 211 of the previous frame 31. The impulse signal module 59 receives the second predetermined gray level signal 212 and the first predetermined gray level signal 211, which is stored in the memory 51, and generates a plurality of impulse signal, such as the first impulse signal 231 and the second impulse signal 232. The first impulse signal 231 and the second impulse signal 232 are both sent to the first multiplexer 56 through the second multiplexer 54.

The impulse signal module 59 uses the impulse signal data table 52 thereof to generate the first impulse signal 231 and the second impulse signal 232. The impulse signal data table 52 receives the second predetermined gray level signal 212 of the current frame 32 and also receives the first predetermined gray level signal 211, which is stored in the memory 51. With both of the first impulse signal 231 and the second impulse signal 232 as determining factors, the system 50 is able to check the impulse signal data table 52 to generate the first impulse signal 231, which is sent to the second multiplexer 54, and also generates the second impulse signal 232, which is sent to the delayer 53.

The delayer 53 is adapted to receive the second impulse signal 232. The delayer 53 can store the second impulse signal 232 for delaying the second impulse signal 232 transferring to the second multiplexer 212. The delayer 53 is also for generating a second control signal 63 to the second multiplexer 54. The second multiplexer 54 is based on the second control signal 63 to sequentially transmit the first impulse signal 231 and the second impulse signal 232 to the first multiplexer 56 in response to the second control signal 63.

The detection unit 55 is for generating a first control signal 65 to be applied to the first multiplexer 56 according to the first predetermined gray level signal 211 and the second predetermined gray level signal 212. The detection unit 55 receives the second predetermined gray level signal 212 and receives the first predetermined gray level signal 211 stored in the memory 51. Then, the detection unit 55 compares whether the first predetermined gray level signal 211 and the second predetermined gray level signal 212 have the equal value, for detecting the current frame (FIG. 3B 32) is in "static state" or in "dynamic state". Base on the comparing result to determine the value of the first control signal 65. In an embodiment of the present invention, if the comparing result shows "static state", the value of the first control signal 65 is then determined to be zero (0). In this case, the first multiplexer 56 only output the second impulse signal 232 for "hold-type" driving. If the comparing result shows"dynamic state", the value of the second control signal 65 is then determined to be one (1). In this case, the first multiplexer 56 sequentially output the first impulse signal 231 and the second impulse signal 232 for "impulse-type" driving.

The system 50 represents a practical product of the present method for driving liquid crystal display. All kinds of the video signal 21 coming from video disk player (DVD or VCD), computer VGA card or other video source, is able to be detected each frame of "static state" or of "dynamic state" by the system 50, according to compare two neighboring frames. Moreover, the system 50 is able to automatically react upon detection result to generate the driving signal 23 having specific signal values for both of the "hold-type" driving and the "impulse-type" driving.

Figure 6A:
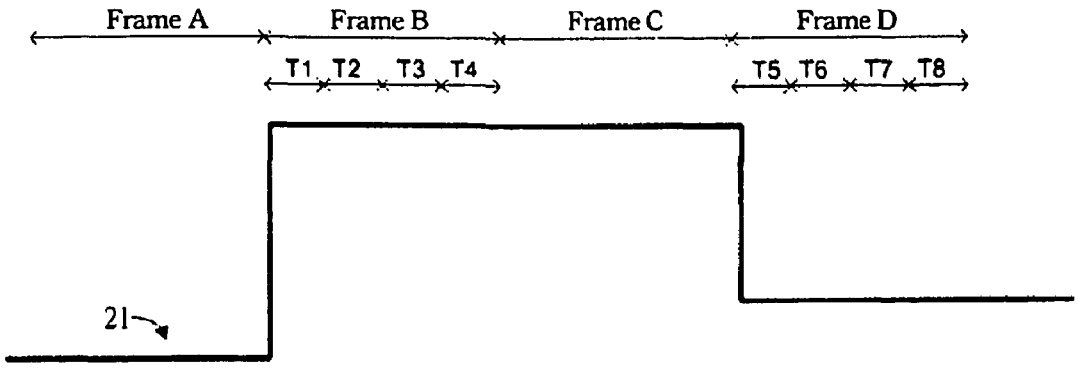
FIG. 6A, FIG. 6B and FIG. 6C each illustrates video signal, driving signal and brightness changing condition of pixel in an embodiment of the present invention.
Figure 6B:
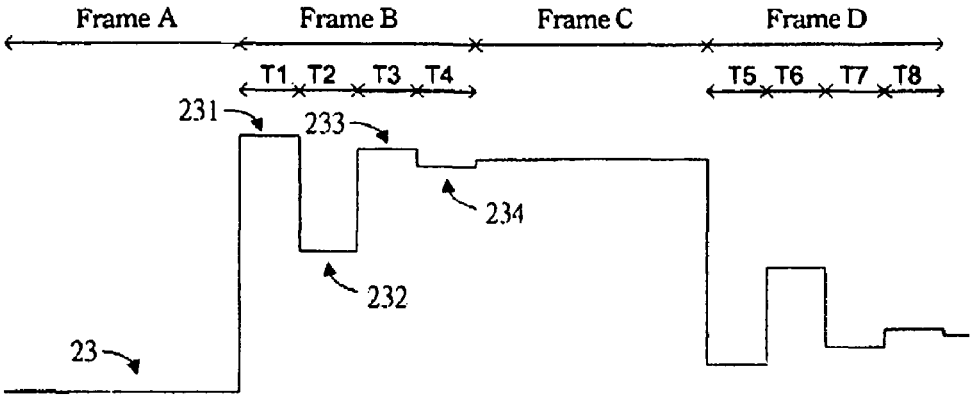
Figure 6C:
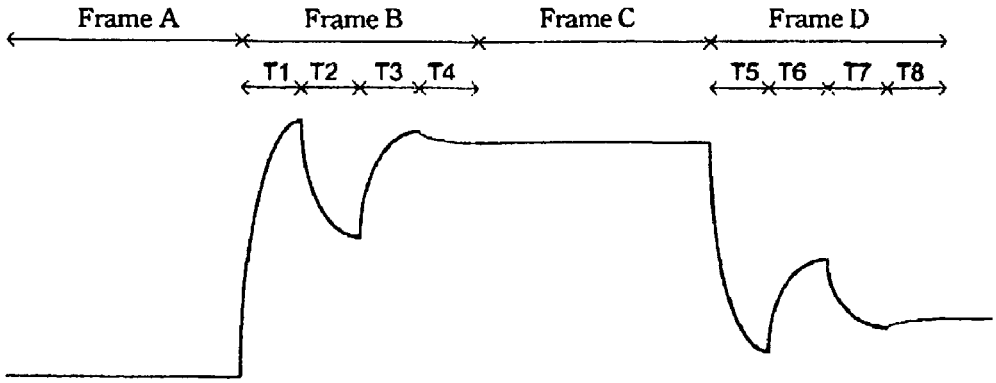

Please refer to FIG. 6A, FIG. 6B and FIG. 6C for another embodiment. Each of them illustrates the video signal 21, the driving signal 23 and the brightness changing condition of pixel 121, respectively. In this embodiment, a frame of "dynamic state" (e.g. frame b), has four corresponding impulse signals (differentiated by time division T1, T2, T3 and T4). The practical performance is shown in FIG. 6C.

As shown in FIG. 6A, the video signal 21 requesting to display the same gray level in the frame b and the frame c. Although the frame b is driven by "impulse-type" driving and the frame c is driven by "hold-type" driving, the brightness accumulation values of the frame b and the frame c are the same.

To achieve this embodiment (FIG. 6A to FIG. 6C), the system 50 showed in FIG. 5 need to be modified. The content of impulse signal data table 52 is different from the previously mentioned embodiment. The amount of the output impulse signals are increased from two to four.

The impulse signal data table 52 receives the second predetermined gray level signal 212 and the first predetermined gray level signal 211, accordingly, to generate a first impulse signal 231, a second impulse signal 232, a third impulse signal 233 and a forth impulse signal 234, each belonging to time division T1, T2, T3, and T4. These four impulse signals are transmitted to the first multiplexer 56 sequentially through the second multiplexer and the delayer 53.

Please refer to FIG. 3A and FIG. 3B. Another method for driving liquid crystal display includes following steps:

a) comparing the gray level associated with the second predetermined gray level signal 212 to the gray level associated with the first predetermined gray level signal 211.

b-1) applying hold-type voltage to drive the pixel 121 in the current frame 32 if the gray level associated with the second predetermined gray level signal 212 and the gray level associated with the first predetermined gray level signal 211 are substantial the same.

b-2) applying an impulse-type voltage to drive the pixel 121 in at least one frame subsequent to the current frame 32 if the gray level associated with the second predetermined gray level signal 212 and the gray level associated with the first predetermined gray level signal 211 are different.

Figure 7A:
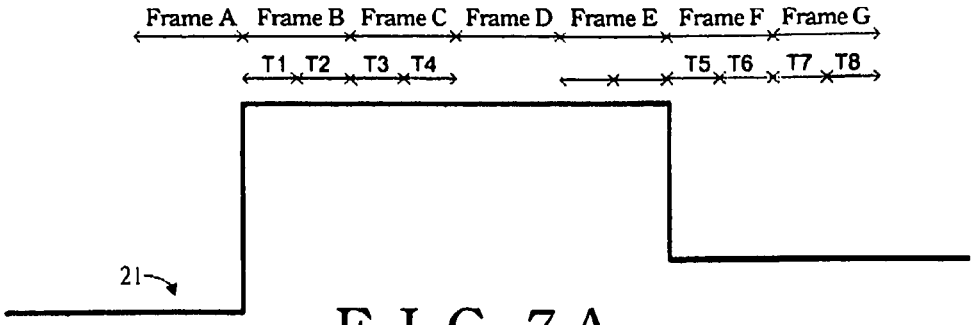
FIG. 7A, FIG. 7B and FIG. 7C each illustrates video signal, driving signal and brightness changing condition of pixel in an embodiment of present invention.
Figure 7B:
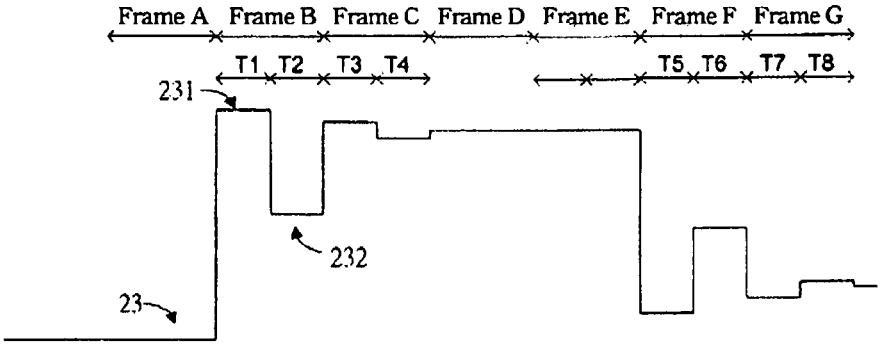
Figure 7C:
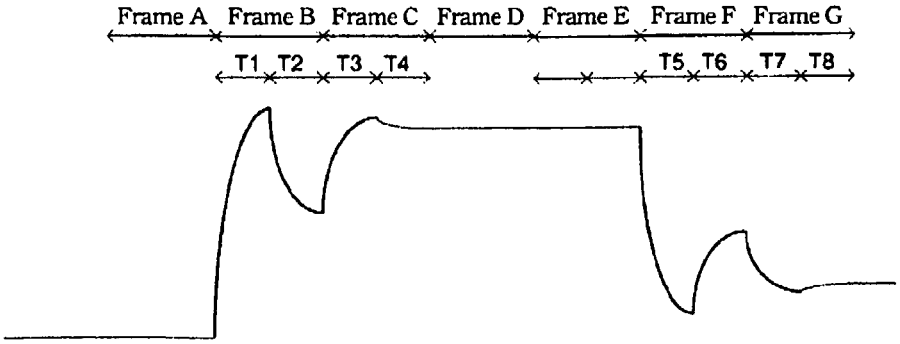

Please refer to FIG. 7A, FIG. 7B and FIG. 7C, which separately demonstrate another embodiment of the present invention. Each illustrates the video signal 21, the driving signal 23 and the brightness changing condition of pixel 121. This embodiment is similar to the previously embodiment of FIG. 4A, FIG. 4B and FIG. 4C. The applied "impulse-type" driving has two impulse signals (e.g. 231 and 232) in a dynamic-state frame (e.g. frame B or frame F).

The differences which set this embodiment apart from the embodiment of FIG. 4A, FIG. 4B and FIG. 4C is: in the embodiment of FIG. 7A, FIG. 7B and FIG. 7C, when dynamic-state frame occurs, then also make a consecutive decision for applying the "impulse-type" driving to at least one frame subsequent to the current frame 32. Referring to FIG. 7B, "impulse-type" driving is applied to drive frame B. Then back to FIG. 7A, although the following frame C and frame B having the same gray level, which means a "static state", because of the rule mentioned above, then still apply "impulse-type" driving to drive frame C.

The reason of this embodiment is that putting the physical property of liquid crystal molecules in consideration. Please refer to FIG. 4B and FIG. 4C, the embodiment of FIG. 4B applies "hold-type" driving to drive frame C in "static state". However, because of the physical property of liquid crystal molecules shows a slower response time. As shown in FIG. 4C, pixel 121 is unable to reach the required brightness at the early stage of frame C. Therefore the actual brightness accumulation value in the frame time of frame C will be lower than expected.

Consequently, this embodiment applies "impulse-type" driving to two consecutive frames when dynamic-state frame occurred. This is able to improve the condition of brightness inaccuracy on screen when "impulse-type" driving frame (e.g. frame B) following by a frame (e.g. frame C in FIG. 4B) have been driven by "hold-type" driving.

About the rules being used in the embodiment of FIG. 7A, FIG. 7B and FIG. 7C (when dynamic-state frame occurred, then applying an "impulse-type" for driving the pixel 121 in the current frame 32, and also making a consecutive decision for applying the impulse-type driving to at least one frame after the current frame 32) is accomplished by the detection unit 55 in actual application.

The detection unit 55 outputs the first control signal 65 which has the signal value corresponding to the "impulse-type" driving to two consecutive frames when detecting the first predetermined gray level signal 211 and the second predetermined gray level signal 212 being different gray level. For example, as to the embodiment of FIG. 5, making the value of the first control signal 65 is equal to one (1) and applying it to two consecutive frames. And then the method shown in FIG. 7A, FIG. 7B and FIG. 7C is thus able to be accomplished.

Summarizing the above, the present invention provides a method and a system for driving liquid crystal display. Problems of liquid crystal display in "dynamic state" and in "static state" can be improved through the present invention. The present invention is able to make comparison of two consecutive frames, detecting whether the current frame a "dynamic frame" or "static frame". Furthermore, the present invention applies "impulse-type" driving to "dynamic state", "hold-type" driving to "static state". The present invention provides a complete resolution to problems of dragging screen image phenomenon and screen flashing of prior art liquid crystal display technology.

With the example and explanations above, the features and spirits of the invention are hopefully well described. Those skilled in the art will readily observe that numerous modifications and alterations of the device may be made while retaining the teaching of the invention. Accordingly, the above disclosure should be construed as limited only by the metes and bounds of the appended claims.

What is claimed is:

1. A method for driving a liquid crystal display, the liquid crystal display including a plurality of pixels, each pixel being capable of displaying a plurality of gray levels, a first predetermined gray level signal determining a corresponding gray level for one of the plurality of pixels in a previous frame, a current frame following immediately after the previous frame, and a second predetermined gray level signal determining a corresponding gray level for the one of the plurality of pixels in the current frame, the method comprising:

comparing the gray level associated with the second predetermined gray level signal to the gray level associated with the first predetermined gray level signal;

applying a hold-type voltage to drive the pixel in the current frame if the gray level associated with the second predetermined gray level signal and the gray level associated with the first predetermined gray level signal are substantially the same; and applying an impulse-type voltage to drive the one of the plurality of pixels in the current frame if the gray level associated with the second predetermined gray level signal and the gray level associated with the first predetermined gray level signal are different, wherein the impulse-type voltage includes four impulse signals, and the four impulse signals are input in sequence to the pixel during the current frame.

2. The method of claim 1, wherein applying the impulse-type voltage includes applying a plurality of impulse signals to one of the plurality of pixels within a current frame time for spinning multiple liquid crystal molecules in the liquid crystal display.

3. The method of claim 2, wherein the one of the plurality of pixels is driven by the impulse-type voltage in such a manner that the brightness of the pixel is mainly distributed at the early stage of the frame time.

4. The method of claim 1, wherein applying the hold-type voltage includes applying the gray level signal to the one of the plurality of pixels for maintaining a predetermined tilt angle of liquid crystal molecules of the pixel within the frame time of the current frame.

5. The method of claim 1, wherein the one of the plurality of pixels is driven by the hold-type voltage in such a manner that the brightness of the pixel is evenly distributed within the frame time of the current frame.

6. The method of claim 1, wherein the brightness accumulation value of the pixel within the frame time is the same under the impulse-type and the hold-type when the second predetermined gray level and the first predetermined gray level are of the same value.

7. A method for driving a liquid crystal display, the liquid crystal display including a plurality of pixels, each pixel being capable of displaying a plurality of gray levels, a first predetermined gray level signal determining a corresponding gray level for one of the plurality of pixels in a previous frame, a current frame following immediately after the previous frame, and a second predetermined gray level signal determining a corresponding gray level for the one of the plurality of pixels in the current frame, the method comprising:

comparing the gray level associated with the second predetermined gray level signal to the gray level associated with the first predetermined gray level signal;

applying a hold-type voltage to drive the pixel in the current frame if the gray level associated with the second predetermined gray level signal and the gray level associated with the first predetermined gray level signal are substantial the same; and applying an impulse-type voltage to drive the one of the plurality of pixels in at least one frame subsequent to the current frame if the gray level associated with the second predetermined gray level signal and the gray level associated with the first predetermined gray level signal are different, wherein the impulse-type voltage includes four impulse signals, and the four impulse signals are input in sequence to the pixel during the frame subsequent to the current frame.

8. The method of claim 7, wherein applying the impulse-type voltage includes applying a plurality of impulse signals to one of the plurality of pixels within a current frame time for spinning multiple liquid crystal molecules in the liquid crystal display.

9. The method of claim 8, wherein the one of the plurality of pixels is driven by the impulse-type voltage in such a manner that the brightness of the pixel is mainly distributed at the early stage of the frame time.

10. The method of claim 7, wherein the hold-type includes applying the gray level signal to the one of the plurality of pixels for maintaining a predetermined tilt angle of liquid crystal molecules of the pixel within the frame time of the current frame.

11. The method of claim 7, wherein the one of the plurality of pixels is driven by the hold-type voltage in such a manner that the brightness of the pixel is evenly distributed within the frame time of the current frame.

12. The method of claim 7, when the second predetermined gray level is of a same "value", the brightness accumulation value of the pixel within the frame time being the same under the impulse-type driving or the hold-type.

13. A system for driving a liquid crystal display, the system receiving a video signal including a first predetermined gray level signal and a second predetermined gray level signal, the first predetermined gray level signal determining a corresponding displaying gray level for a pixel in a previous frame, the second predetermined gray level signal determining a corresponding displaying gray level for the pixel in a current frame subsequent to the previous frame, the system comprising:

a memory for storing the first predetermined gray level signal;

an impulse signal module for receiving the first predetermined gray level signal and the second predetermined gray level signal to generate a plurality of impulse signals;

a first multiplexer for receiving the plurality of impulse signals and outputting the second predetermined gray level signal or the plurality of impulse signals according to the first control signal; and a detection unit for generating a first control signal to be applied to the first multiplexer according to whether the gray level associated with the first predetermined gray level signal and the gray level associated with the second predetermined gray level signal are substantial the same or not, for switching the impulse-type driving or the hold-type driving.

14. The system of claim 13, wherein the impulse signal module having an impulse signal data table receives the second predetermined gray level signal and the first predetermined gray level signal to generate a first impulse signal and a second impulse signal according to the second predetermined gray level signal and the first predetermined gray level signal.

15. The system of claim 14, wherein the impulse signal module includes a second multiplexer adapted to receive the first impulse signal.

16. The system of claim 15, wherein the impulse signal module includes a delayer adapted to receive the second impulse signal, for delaying the second impulse signal transferring to the second multiplexer, and for generating a second control signal to the second multiplexer.

17. The system of claim 16, wherein the second multiplexer sequentially transmits the first impulse signal and the second impulse signal to the first multiplexer in response to the second control signal.

18. The system of claim 13 further comprising an impulse signal data table, wherein the plurality of impulse signals are generated from the impulse signal data table according to the second predetermined gray level signal and the first predetermined gray level signal.

* * * * *